United States Patent [19]

Gazda et al.

[11] Patent Number: 4,928,761

[45] Date of Patent: May 29, 1990

[54] TWO-WAY PLUGS FOR WELLS

[75] Inventors: Imre I. Gazda, Fort Worth; Dannie R. Collins, The Colony, both of Tex.

[73] Assignee: Otis Engineering Corporation, Dallas, Tex.

[21] Appl. No.: 381,161

[22] Filed: Jul. 17, 1989

[51] Int. Cl.[5] ..... E21B 23/02

[52] U.S. Cl. ..... 166/123; 166/125; 166/182

[58] Field of Search ..... 166/123, 125, 135, 181, 166/182, 192

[56] References Cited

U.S. PATENT DOCUMENTS

| | | | |
|---|---|---|---|
| 2,698,056 | 12/1954 | Marshall et al. | 166/123 |
| 2,798,559 | 7/1957 | Fredd | 166/125 |
| 2,894,586 | 7/1959 | Schramm et al. | 166/181 X |
| 2,920,704 | 1/1960 | Fredd | 166/125 |
| 2,962,097 | 11/1960 | Dollison | 166/136 |
| 2,976,931 | 3/1961 | Daffin | 166/125 |
| 3,002,565 | 10/1961 | Moore, Jr. | 166/217 |
| 3,032,113 | 5/1962 | Dollison | 166/125 |
| 3,051,239 | 8/1962 | Dollison | 166/125 |
| 3,100,532 | 8/1963 | Tampler | 166/181 X |
| 3,126,908 | 3/1964 | Dickens | 137/460 |
| 3,207,222 | 9/1965 | Tampler | 166/136 |
| 3,208,531 | 9/1965 | Tampler | 166/125 |
| 3,215,208 | 11/1965 | Tampler | 166/198 |
| 3,227,462 | 1/1966 | Tampler | 277/34 |
| 3,250,331 | 5/1966 | Boyle | 166/133 |
| 3,638,723 | 1/1972 | Carroll | 166/215 |
| 3,756,260 | 9/1972 | Fredd et al. | 137/1 |
| 4,023,620 | 5/1977 | Gazda et al. | 166/217 |
| 4,069,865 | 1/1978 | Gazda et al. | 166/113 |
| 4,116,277 | 9/1978 | McGee et al. | 166/182 X |
| 4,164,977 | 8/1979 | Arendt et al. | 166/125 |
| 4,181,344 | 1/1980 | Gazda | 166/125 X |
| 4,252,143 | 2/1981 | Fredd | 137/115 |
| 4,396,061 | 8/1983 | Tampler et al. | 166/217 |
| 4,405,017 | 9/1983 | Allen et al. | 166/125 X |
| 4,510,995 | 4/1985 | Krause, Jr. et al. | 166/217 |
| 4,545,434 | 10/1985 | Higgins | 166/217 |
| 4,576,236 | 3/1986 | Stout et al. | 166/192 X |
| 4,583,591 | 4/1986 | Krause, Jr. et al. | 166/217 |
| 4,716,963 | 1/1988 | George et al. | 166/182 X |
| 4,745,974 | 5/1988 | Higgins | 166/217 |
| 4,767,145 | 8/1988 | Bullard | 244/86.18 |
| 4,823,872 | 4/1989 | Hopmann | 166/217 |
| 4,838,594 | 6/1989 | Bullard | 166/125 X |

OTHER PUBLICATIONS

Otis General Sales Catalog.
Otis Wireline Sussurface Flow Controls.

*Primary Examiner*—William P. Neuder
*Attorney, Agent, or Firm*—Albert W. Carroll

[57] ABSTRACT

A plugging device for installation as by wireline tools in a receptacle in a wall flow conductor for plugging the flow conductor against flow from below as well as from above, the plugging device including a tubular housing having seals for sealing with the receptacle, lock members for anchoring it therein, a mandrel reciprocable in the housing between lower and upper positions for moving the lock members to locking position and for allowing them to move to unlocking position, a plug member closing the housing and being movable relative thereto between lower and upper positions, and a locking mechanism for locking the plug member to the mandrel whenever the mandrel is in its lower position and the plug member is moved to its upper position to prevent the mandrel from being moved to its unlocking position. A running tool is provided for installing the plugging device which will not release the device unless it is properly installed in the receptacle.

26 Claims, 9 Drawing Sheets

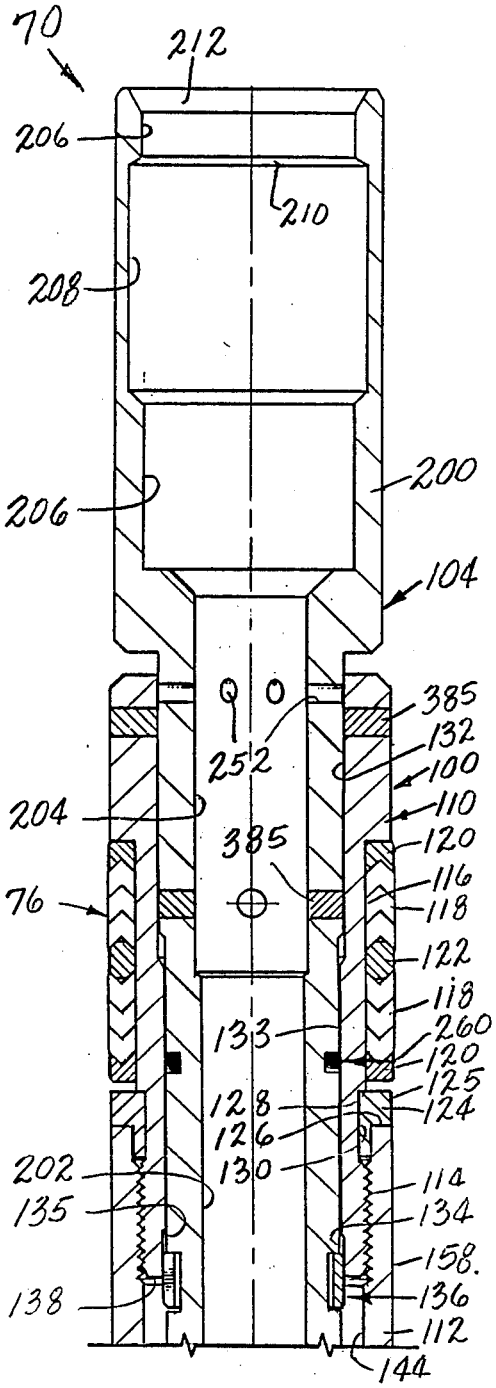
FIG. 4A
FIG. 5
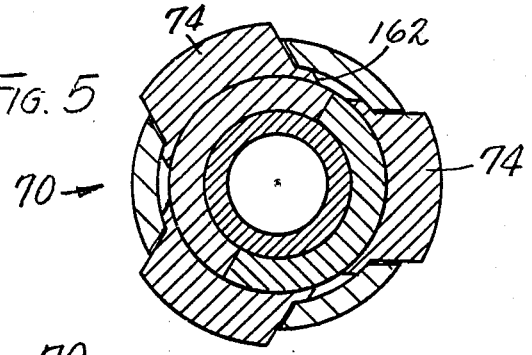
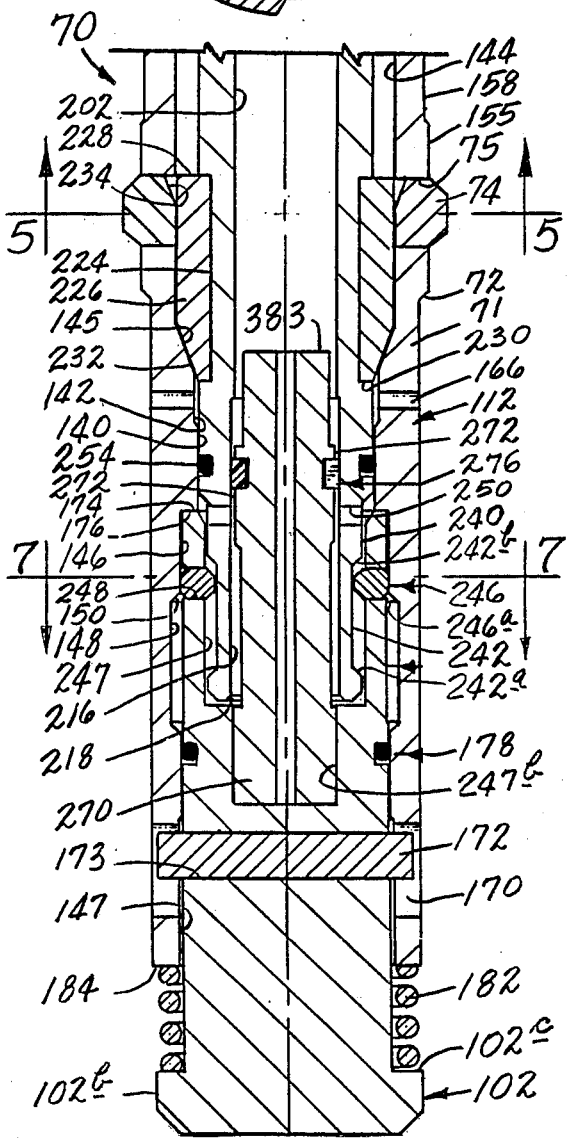
FIG. 4B

TWO-WAY PLUGS FOR WELLS

BACKGROUND OF THE INVENTION

1. Field of the Invention:

This invention relates to well tools and more particularly to tools for plugging well flow conductors and running tools and receptacles for such plugging tools.

2. Related Art and Information

In the past wells have oftentimes been plugged at or near the lower end of the well tubing for preventing production, or to permit bleeding the tubing pressure to that of the atmosphere so that the wellhead or a portion of the well tubing could be removed, or so that pressure applied above the plug could be used to test the tubing, set the packer, or test the packer.

Various types of plugs have been used for such tests. Generally, such plugs are installed in a landing receptacle, which forms a portion of the tubing string, through use of wireline equipment and techniques. Some plugs are designed to hold against high pressure from below, some are designed to hold overpressure from above, and some are designed as two-way plugs to withstand pressure differentials from either above or below. The latter type is often desirable since it will permit a greater variety of testing operations to be conducted.

Two-way plugs are well known in the oil industry. Suitable two-way plugs are available from Otis Engineering Corporation, Dallas, Tex., and are found illustrated in their General Sales Catalog "OEC 5338". They are the Otis Type PX, PR, PXN, PRN, and PRT Plug Choke Assemblies and the Type XX, RR, XXN, RRN, and RNT found on page 126 of that catalog. These plugs are designed for installation in Type X, XN, R, RN, or RNT Landing Nipples, shown on page 116 of the catalog, with the exception of the Type RNT Landing Nipple. The Type RNT Landing Nipple is the same configuration as the Type RN but with slightly smaller inside diameters. These plugs are generally run on running tools such as the RXN illustrated on page 307 of the catalog.

Type PN and PS Choke Assemblies are found on page 127 of the Otis Catalog. The letter "N" in the above used designations indicates a no-go device and of course a no-go device such as a Type PN must be installed in a Type N no-go landing nipple.

It is generally preferable that the lowermost landing nipple in a well be one of the no-go type.

Many of the plugs and landing nipples have been either premium-priced or too expensive to run and/or pull, sometimes requiring extra trips into the well with the wireline tools. More economical plugs and landing nipples have been desired, as well as cheaper, more dependable running tools.

Various landing receptacles, locking devices, plugs, and running tools are illustrated and described in the prior art patents listed below (one copy of each of which is being filed with this application for patent), as well as in the catalog referred to hereinabove.

| Patents of the United States | | | | |
|---|---|---|---|---|
| 2,698,056 | 3,002,565 | 3,208,531 | 4,023,620 | 4,545,434 |
| 2,798,559 | 3,032,113 | 3,215,208 | 4,069,865 | 4,583,591 |
| 2,920,704 | 3,051,239 | 3,227,462 | 4,164,977 | 4,745,974 |
| 2,928,469 | 3,100,532 | 3,250,331 | 4,252,143 | 4,767,145 |
| 2,962,097 | 3,126,908 | 3,638,723 | 4,396,061 | 4,823,872 |

-continued

| Patents of the United States | | | |
|---|---|---|---|
| 2,976,931 | 3,207,222 | 3,756,260 | 4,510,995 |

Publications

Otis Wireline Subsurface Flow Controls & Related Service Equipment catalog, OEC 5121C, pages 14, 16, 17, 22, 24, 106, 108, 110 and 112—115,—Published October 1980, by Otis Engineering Corporation P.O. Box 819052, Dallas, Tex. 75381-9052.

Otis General Catalog, OEC 5338, pages 116, 117, 125–127, and 307,—Published March 1985 by Otis Engineering Corporation, P.O. Box 819052, Dallas, Tex. 75381-9052.

Various plugs, which are designed to be installed in a well and removed therefrom through use of wireline equipment are illustrated and described in catalog OEC 5121C and in catalog OEC 5338 of Otis Engineering Corporation, just mentioned, together with suitable landing nipples as well as running and pulling tools therefor. Plugging devices are found on pages 126 and 127 of catalog OEC 5338. The Otis Type PX, PR, PXN, PRN, and PRT Plug Choke Assemblies are designed for use where sediment may occur and bailing might be required before pressures across the plug can be equalized. Two trips are required to install these plugs; and two trips are required to retrieve them. The Type XX, RR, XXN, RRN, and RNT devices may be run in a single trip and pulled in a single trip but are not designed for use where sediment may occur. The Type PS and PN devices may be used where sediment may occur but each is run in one trip, then pulled in two trips. All of these plugging devices are two-way plugs (they prevent fluid flow both from below and from above). They are installable in proper landing nipples in wells for plugging the wells against flow in either upward or downward direction. Such landing nipples include Otis Type X, R, XN, RN, N and S Landing Nipples which are found on pages 116 and 117 of catalog OEC 5338.

Otis Type X, R. and RXN Running Tools are found on page 307, same catalog.

Otis Type RX, X, R, and the Type GS Running and Pulling Tools are found on page 113 of catalog OEC 5121C. Of the running tools shown in these catalogs, only the Otis Type GS Running and Pulling Tool is capable of running the plug device of the present invention but is not capable of doing so with absolute reliability. The Type GR Pulling Tool is the tool recommended for pulling the plug device of the present invention.

U.S. Pat. No. 2,698,056 which issued to S. J. E. Marshall, et al. on Dec. 28, 1954 illustrates and describes a locking device which locks in a landing nipple for well tubing, the locking mechanism including lock members 46 which are moved from their retracted position of FIG. 2 outwardly to an expanded position of FIGS. 3 and 4 by moving the expander sleeve 32 from its upper position down to its lower position. Similar locking means are seen in FIGS. 7 and 11. In either case, lifting of the expander sleeve to its upper position allows the lock members to retract to unlocking position. Similar locking means are disclosed in U.S. Pat. Nos. 2,798,559; 2,920,704; 2,962,097; 2,976,931; 3,002,565; 3,032,113; 3,051,239; 3,207,222; 3,208,531; 3,638,723; 4,023,620;

4,069,865; 4,164,977; 4,396,061; 4,510,995; 4,545,434; 4,583,591; 4,747,974; and 4,823,872.

U.S. Pat. No. 2,962,097 which issued to William W. Dollison on Nov. 29, 1960 illustrates and describes an early pulling and running tool of the GS Type and having keys 77 biased downwardly by Spring 80 to be expanded by nose 66, as shown in FIG. 6. U.S. Pat. Nos. 3,032,113 and 3,051,239 matured from divisional applications which were divided out of the parent application which matured into U.S. Pat. No. 2,962,097.

U.S. Pat. No. 3,207,222 issued on Sept. 21, 1965 to J. W. Tamplen and discloses a locking device and running tool therefor which resembles the Otis Type X locking device and running tool therefor.

U.S. Pat. No. 3,208,531 issued to J. W. Tamplen on Sept. 28, 1965 and discloses a locking device and a running tool therefor which is an improvement over the invention disclosed in U.S. Pat. No. 3,207,222.

U.S. Pat. No. 4,545,434 issued on Oct. 8, 1985 to Brian D. Higgins and discloses a running tool for running a surface controlled subsurface safety valve. In setting the safety valve, which was held open against the force of the safety valve spring by the running tool for the trip into the well, control pressure applied thereto from the surface relieves the safety valve spring force, after which the running tool is lifted to lock the safety valve in its receptacle and release the running tool from the safety valve for retrieving the running tool from the well.

U.S. Pat. No. 4,745,974 issued to Brian D. Higgins on May 24, 1988 and discloses a running tool, similar to that disclosed in his just mentioned U.S. Pat. No. 4,545,434, and performs the operation of setting a surface controlled subsurface safety valve, during which, after the safety valve is landed in the landing nipple, control pressure is applied to relieve the safety valve spring force to permit lifting of the running tool to cause locking of the safety valve in the landing nipple and release of the running tool from the safety valve for withdrawal from the well.

U.S. Pat. No. 4,164,977 issued to Henry P. Arendt, et al, on Aug. 21, 1979 and teaches use of a detent ring 82 and external recess 86 for releasably detaining the fishing neck 104 in key expanded position, seen in FIG. 3, to maintain the well latch locked in its receptacle 20. U.S. Pat. Nos. 4,510,995 and 4,583,591 show similar detents. Other detents are found in U.S. Pat. Nos. 2,920,704; 2,976,931; 4,396,061; 4,510,995; 4,545,434; 4,583,591; 4,745,974; and 4,823,872.

U.S. Pat. Nos. 3,126,908 issued to G. C. Dickens on Mar. 31, 1964 and discloses the use of transfer members (balls 193 of FIGS. 3–7, for instance) for latching the spring loaded cage 195 first to the operator tube 140 as in FIG. 6, and then to the housing 128 as in FIG. 7. Similar transfer means are seen in U.S. Pat. No. 3,215,208; 3,227,462; 3,638,723; 3,756,260; 4,252,143; 4,545,434; 4,745,974; and 4,823,872.

U.S. Pat. No. 3,250,331 which issued to W. G. Boyle on May 10, 1966 illustrates a wellhead plug device having a poppet type, equalizing valve 30, openable by depressing with a well tool and prong (not shown). (See bottom portion of Column 4). The plug disclosed in this patent will hold pressure only from below.

U.S. Pat. No. 4,164,977 similarly shows an equalizing passage 22 whose upper open end may be sealed or bridged by the o-ring seals 28 and 30, but may be opened for equalizing pressures thereacross by moving the valve 24 to its lower position shown in FIG. 1. Further, equalizing devices for use with various well tools such as locking devices, for instance, are found on page 125 of catalog OEC 5338, supra.

U.S. Pat. No. 2,698,056 shows a landing nipple 20 having a no-go shoulder at its extreme upper end which is engaged by a no-go shoulder provided by external annular flange 52 (FIGS. 2 and 3) to limit downward movement of the locking device C in the landing nipple. No-go shoulders in landing nipples and on wireline installable devices are found also in U.S. Pat. Nos. 2,976,931; 3,002,565; 3,100,532; 3,250,531; 4,023,620; 4,510,995; 4,545,434; 4,583,591; 4,745,974; and 4,823,872.

There was not found in the known prior art a well plugging device for installation in a landing receptacle in a well for prohibiting flow therethrough wherein such plugging device includes a housing carrying seal means and lock means for sealing and locking the device in the landing nipple and having a plug member mounted on its lower end for limited longitudinal movement relative thereto between lower and upper positions and wherein a mandrel is reciprocable in the housing between a lower position wherein it maintains the locking means locked in the landing nipple and an upper position in which it permits the locking means to retract from locking position to releasing position and wherein when the mandrel is in its lower (locking) position and the plug member is moved from its lower to its upper position as by higher pressure therebelow the plug member will automatically become locked to the mandrel and will not permit the mandrel to be lifted to its upper (unlocking) position. Thus, the plugging device cannot be unlocked when the pressure therebelow exceeds that thereabove sufficiently to maintain the plug in its upper position.

SUMMARY OF THE INVENTION

The present invention is directed to plugging devices for wells and to landing nipples and running tools therefor, the landing nipple being connectable into a well flow conductor, and adapted to receive the plugging device, the plugging device being installable in the landing nipple as through the use of the companion running tool and wireline tools, or the like, the plugging device including a housing carrying means for lockingly and sealingly engaging the landing receptacle and having a plug member at its lower end which is movable relative thereto between lower and upper positions, a mandrel having its lower position telescoped into the housing and movable between upper and lower positions such that when the mandrel is in its lower position it holds the lock means locked with the landing nipple, and when in its upper position it permits the lock means to move to unlocking position, but when the mandrel is in its lower position and the plug member is moved to its upper position, the plug member becomes lockingly engaged with the mandrel and the mandrel cannot be moved to its upper, unlocking position. The running tool is attachable to the wireline tools and is engageable with the mandrel the plug device to support the same in its unlocked condition with the mandrel in its upper position. The running tool is used to insert the plugging device into the landing nipple, force the mandrel down to lock the plugging device in the landing nipple and then release itself from the plugging device.

It is, therefore, one object of this invention to provide an improved two-way plugging device for wells and a landing nipple for use therewith, the plugging device being installable in the nipple in locking and sealing engagement herewith in a single trip into the well and removable in another single trip, usually with wireline and tools.

Another object of this invention is to provide such a plugging tool having an equalizing passage therethrough and means associated therewith for holding this passage open to provide a bypass for well fluids while it is being lowered into the well, the equalizing passage then being closed during installation, but being openable to equalize pressures thereacross preparatory to removing the plugging tool from its landing nipple.

Another object is to provide such a plugging device in which a plug member carried at the lower end thereof is movable relative thereto between upper and lower positions, the plugging device having a housing with means thereon for sealingly engaging the inner wall of the landing nipple, and expansible and retractable lock members carried thereby for lockingly engaging in an internal lock recess in the landing nipple, and a mandrel with an expander thereon telescoped into the housing and reciprocable relative thereto between an upper position in which the lock members are retracted and a lower position in which the lock members are expanded into engagement with the internal lock recess in the nipple, and having an internal lock mechanism for locking the mandrel to the plug member when the mandrel is in its lower (locking) position and the plug member is moved from its lower to its upper position as by the pressure beneath the plug member becoming appreciably greater than that above, thus preventing the lifting of the mandrel and consequent locking of the plugging device when the pressure therebelow exceeds that above appreciably.

Another object is to provide a plugging device of the character described having a spring for biasing the plug member to its lower position.

Another object of the invention is to provide a plugging tool of the character described wherein the seals which sealingly engage the landing nipple are located above the locking members and thus, prevent fouling thereof by solid particles settling onto the device from above.

A further object is to provide such a plugging tool in which an internal wiper ring is carried therein for preventing the fouling of the mechanism, which locks the mandrel to the plug member, by solid particles settling inside the plugging tool from above.

Another object is to provide such a plugging device in which the plug member can be forcibly separated from the housing by excessive pressure from above should the plugging device prove too costly and/or too time-consuming to remove via conventional wireline tools and techniques.

Another object of this invention is to provide a running tool for reliably depositing the plugging device in the landing nipple and leaving it there in proper locked and sealed engagement.

Another object is to provide such a running tool which is not secured to the plugging device but is releasably latched thereto only by keys carried thereon engaging the mandrel of the plugging device.

Other objects and advantages may become apparent from reading the description which follows and from studying the accompanying drawing, wherein:

BRIEF DESCRIPTION OF THE DRAWING

FIGS. 4A and 4B, taken together, constitute a longitudinal sectional view of the plugging tool of this invention;

FIG. 5 is a cross-sectional view taken along line 5—5 of FIG. 4B;

DESCRIPTION OF THE PREFERRED EMBODIMENTS

Figure 1:
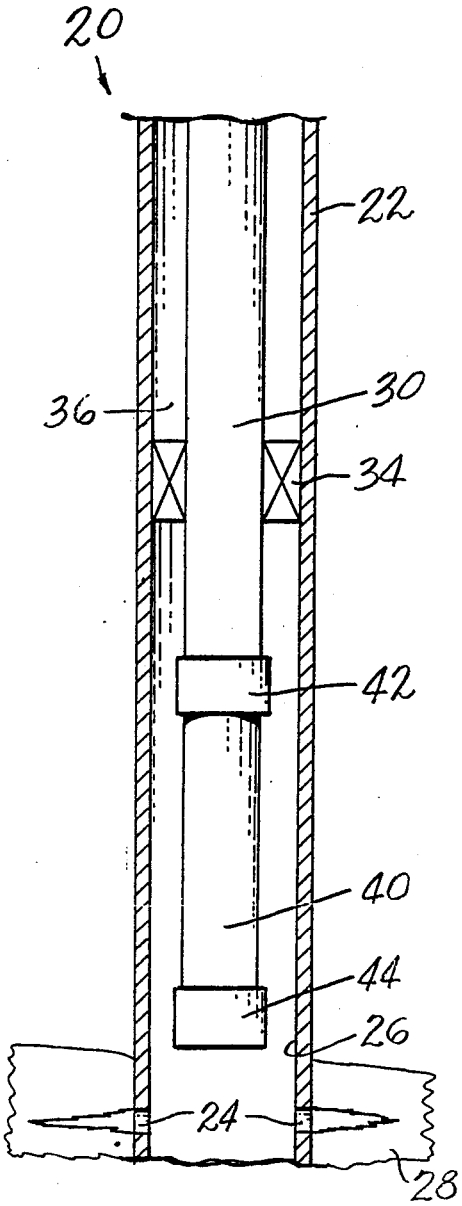
FIG. 1 is a schematical view showing a cased and tubed well with a packer sealing the tubing-casing annulus near the lower end of the tubing, and the tubing having a landing receptacle located below the packer.

Referring now to FIG. 1, it is readily seen that a lower portion of a well 20 is shown. The well 20 is provided with a casing 22 which is perforated as at 24 to communicate the bore 26 of the casing with the formation 28 surrounding the well as shown. A well tubing 30 is disposed within the casing 22 and a well packer 34 seals between the exterior of the tubing and the interior of the casing in the conventional manner. The tubing-casing annulus 36 above the packer is isolated from that below and may contain mud, water, gas, or the like.

The tubing, in this case, is provided with a landing receptacle 40 attached thereto as by coupling 42 and may have another coupling or thread protector 44 on the lower end thereof, as shown. While the landing receptacle is shown located at the lower end of the tubing, it could be located at the upper end, or anywhere inbetween, depending upon the uses anticipated therefor.

Figure 2:
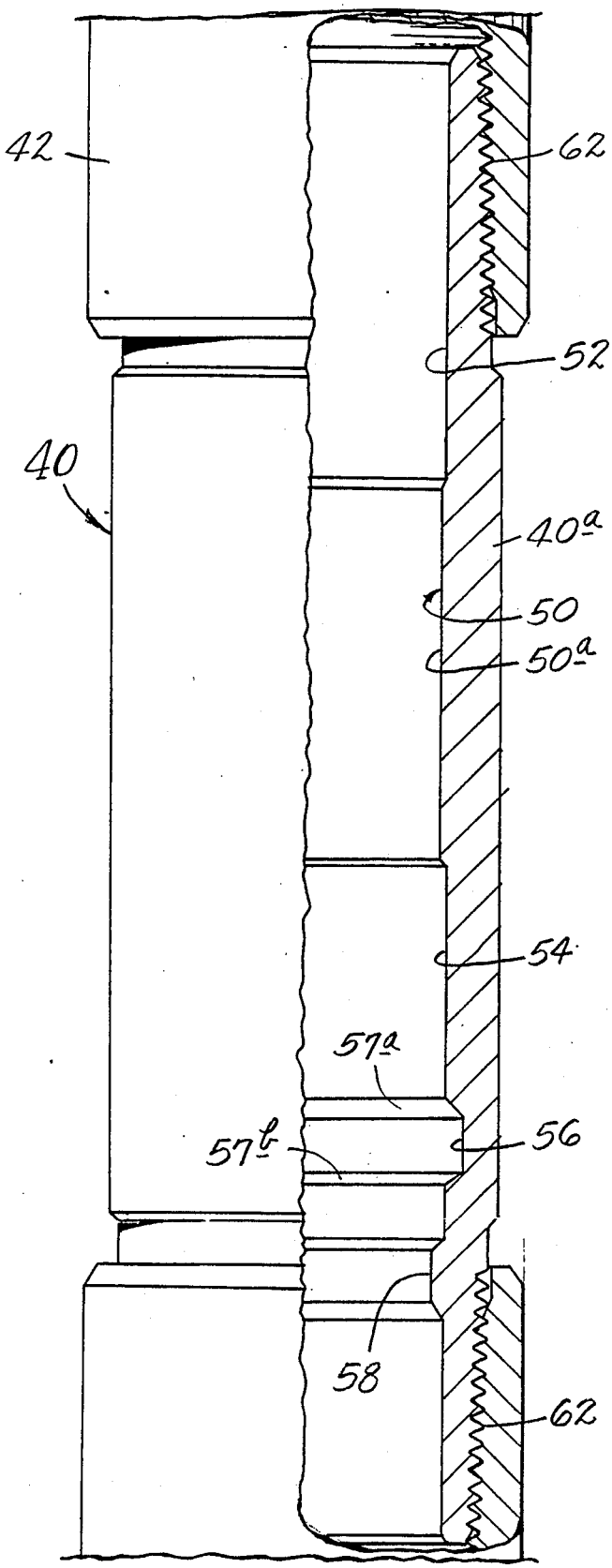
FIG. 2 is a fragmentary view showing the landing receptacle of FIG. 1 cut away to reveal its internal configuration.

Landing receptacle 40 is better seen in FIG. 2. Landing receptacle 40 is provided with a bore 50 which provides a seal bore or smooth bore portion 50*a*. The bore is enlarged slightly as at 52 above the seal bore 50*a*, and also at 54 below the seal bore.

A locking recess 56 is provided in bore 54 a spaced distance below the seal bore 50*a*, and bore 54 is restricted at 58, providing an upwardly facing inclined "no-go" shoulder 60, as shown. At a spaced distance below the restriction 58, bore 54 continues to the lower end of the landing receptacle.

The exterior of the landing receptacle body 40*a* is preferably made suitably large to provide adequate wall thickness to provide a suitably high pressure rating. The upper and, preferably, also the lower end of the landing receptacle is reduced in diameter and threaded as at 62 for attachment in the well tubing to be co-extensive therewith.

In some cases, it may be desirable to have some tubing attached to the lower end of the landing receptacle.

Figure 3:
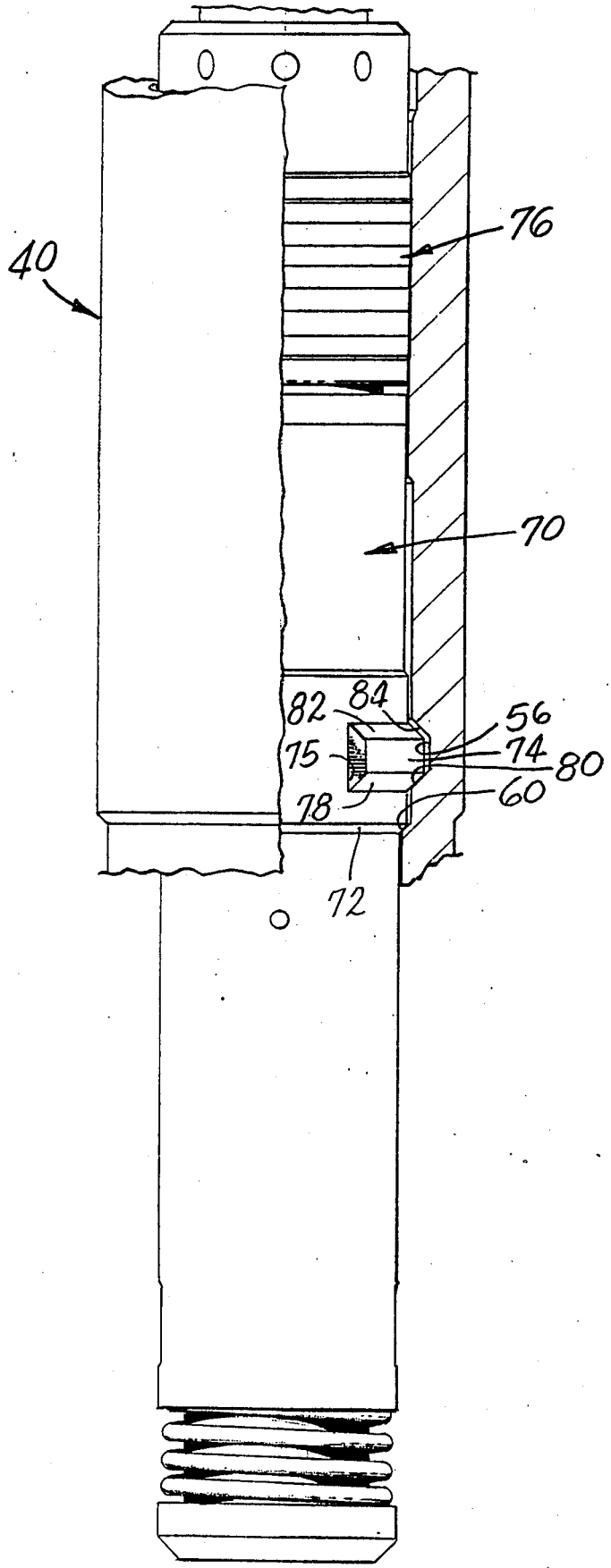
FIG. 3 is a fragmentary view showing the plugging tool of this invention anchored and sealed in the landing receptacle of FIG. 2.

The landing receptacle 40 is adapted to receive a plug device 70 therein in locked and sealed relation therewith as shown in FIG. 3. In installing the plug device in the landing receptacle, it was lowered into the well tubing and inserted in the landing receptacle until its downwardly facing no-go shoulder 72 engaged the upwardly facing no-go shoulder 60 of the receptacle to limit its descent. In this position, its locking means such as the locking lugs 74 carried in windows 75 were expanded to locking position in the locking recess 56 to securely anchor the plug device in the landing receptacle.

The plug device 70 carries seal means such as the packing set 76 which seals between the exterior of the plug device and the inner wall of the landing receptacle. Packing set 76 includes some packing rings facing up and others facing down to seal against fluid flow both from above and below the plug device.

The plug device 70 plugs the bore of the landing receptacle and will withstand substantial pressure differentials from above or below. When the pressure above the plug is appreciably greater than that below, the locking lug 74 will have its downwardly facing lock shoulder 78 engaged with corresponding upwardly facing shoulder 80 of locking recess 56. At this time, the no-go shoulder 72 of the plug device is preferably engaged with the corresponding no-go shoulder 60 of the landing receptacle, as shown. However, when the pressure beneath the plug device appreciably exceeds that above it, the plug device 70 will be lifted and the upwardly facing lock shoulder 82 will engage the downwardly facing shoulder 84 of the locking recess 56.

The plug device 70 is illustrated in greater detail in FIGS. 4A, 4B, and 5, and will now be described.

Plug device 70 essentially comprises tubular housing means 100, plug means 102 for plugging the bore of the housing means, and mandrel means 104 having its lower portion disposed in the bore of said housing means and being reciprocable therein to perform functions yet to be described.

The housing means 100 includes an upper housing 110 and a lower housing 112 which are threadedly connected together as at 114. The upper housing 110 is reduced in outside diameter as at 116 and carries seal means 76 suitable for sealing between the plug device and the landing receptacle. The seal means shown includes upper and lower V-packing 118 backed up by suitable upper and lower female adapter rings 120 and by the double male adapter ring 122 in the middle, as shown. A split compression ring 124 is made in two halves and is reduced in diameter as at 125 providing an external annular flange 125 which overhangs the upper end surface 126 of the lower housing, while the upper inner corner of the split compression ring is engaged against the downwardly facing shoulder 128 formed as a result of the reduction in diameter of the upper housing at 130. It is readily seen that, in this manner, the split compression ring 124 permits proper torquing of thread 114, the compression built up in the ring preventing loosening of the threaded connection.

The upper housing 110 is formed with a bore 132 which is decreased slightly as at 133 and the lower portion of this bore is enlarged slightly to provide a counterbore at 134 and downwardly facing shoulder 135 for receiving the expansible detent ring 136 carried on the mandrel 104 to detain the mandrel 104 in its lower position as shown. The lower end face of upper housing 110 provides a stop shoulder 138 which limits upward relative movement of the mandrel 104 in a manner to be described.

The lower housing 112 is tubular, having a bore 140 which is enlarged slightly as at 142 and then further enlarged as at 144 providing a downwardly facing internal shoulder 145 which is inclined upwardly and outwardly. Bore 140, in the other direction, is enlarged as at 146 and is further enlarged slightly as at 147 the rest of the way to the lower end of the lower housing. An internal annular recess 148 is formed in the wall of bore 146 providing an internal shoulder 150 which is inclined upwardly and inwardly, as shown, and whose purpose will be later explained.

The lower housing 112 has its maximum outside diameter at 155. Its upper portion is reduced in diameter as at 158. The lower portion of the lower housing is reduced in diameter as at 71, providing an inclined downwardly facing no-go shoulder 72, whose purpose was first explained with respect to FIG. 3.

The lower housing 112 is formed with windows 75 in each of which a locking lug 74 is radially movable between retracted and expanded positions. Although not seen in FIG. 4B, the lower housing 112 is formed with an internal annular recess 160, seen in FIG. 5, for receiving the ears 162 formed on the sides of the locking lugs 74 to prevent their falling outward through the windows 75.

An equalizing port 166 is provided in the lower housing 112 at a spaced distance below the no-go shoulder 72 and also below the inclined internal shoulder 145. Preferably a plurality of equalizing ports 166 should be provided. Also, at a spaced distance above its lower end, the lower housing is provided with a pair of opposed longitudinal slots 170.

The plug member 102 has its upper end telescoped into bore 146, 147 of the lower housing 112 and is reciprocable therein between an upper position seen in FIG. 4B, and a lower position, seen later in FIG. 14B. Plug member 102 carries a crosspin 172 disposed in its aperture 173 which extends traversely therethrough and has its opposite ends engaged in the slots 170 of the lower housing. Downward movement of the plug member relative to the lower housing is limited by the ends of crosspin 172, engaging the lower ends of slots 170. Upward movement of the plug member, on the other hand, is limited by its upper end face 174 engaging the downwardly facing shoulder 176 provided where bore 140 of the lower housing is abruptly enlarged at 146.

Plug member 102 carries suitable seal means. The seal means shown is a resilient o-ring 178 carried in an external annular recess in the plug member for sealing between the plug member and the wall of bore 146 of the lower housing. Thus, the plug closes the lower end of tubular lower housing 112.

Figure 6:
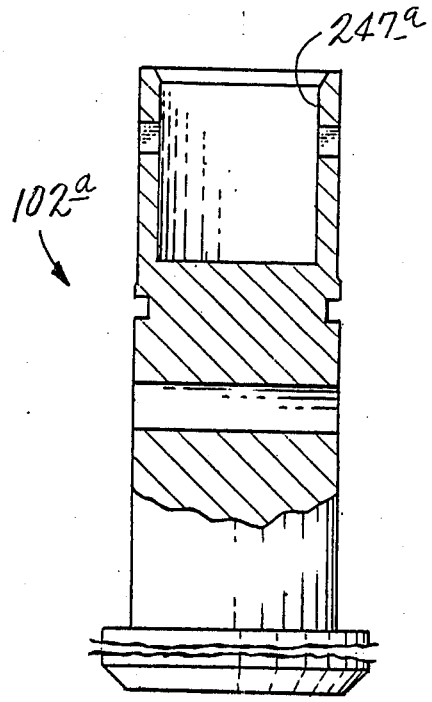
FIG. 6 is a view, partly in longitudinal section and partly in elevation, showing an alternate structure for the plug member of the device seen in FIGS. 4A–4B.
Figure 7:
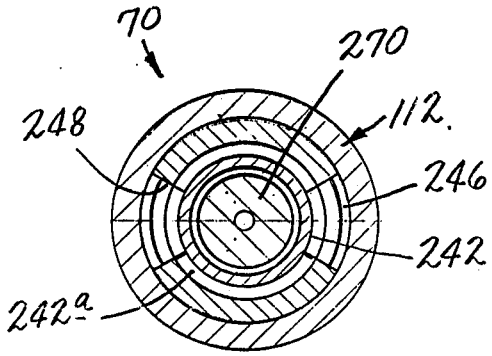
FIG. 7 is a cross-sectional view taken along line 7—7 of FIG. 4B.

The plug member 102 is biased toward its lower position relative to the lower housing. This biasing force may be provided by making the plug member long and heavy so that the weight thereof provides adequate downward gravitational force. FIG. 6 illustrates a plug member 102*a* which could be made as long and heavy as desired. Plug member 102, however, would be preferred over plug member 102*a* in most cases. So far as the biasing means is concerned, the plug member 102*a* would be unnecessarily long and may be difficult to get into and out of a well. Since a lubricator is used in such operations, longer well tools require longer lubricators. If a well tool is too long, and the lucbricator is too short, the lubricator must be made longer as by adding a section thereto. This makes the lubricator long, heavy, and unwieldy, and, of course, more dangerous to handle.

In FIG. 4B, it is seen that plug 102 is quite short and is formed with an external flange 102*b* near its lower end providing an abrupt upwardly facing shoulder 102*c*. A coil spring 182 surrounds the plug member and is supported upon shoulder 102*c* with its upper end engaged against the lower end 184 of the lower housing 112. Thus, the spring biases the plug member downwardly, and the plug member and spring add very little length to the plug device 70.

The spring 182 tends to maintain the plug member 102 in its lower position. When the pressure acting upwardly against the plug member exceeds that acting downwardly thereagainst sufficiently to overcome the bias of spring 182 and the frictional forces, such as the friction of o-ring 178, the plug member will be moved to its uppermost position, shown in FIG. 4B. When such difference in pressures above and below the plug member 102 are almost equalized, the spring, which may apply a downward force of about 50 to 100 pounds, will move the plug member to its lowermost position, seen in FIG. 14B.

Pressures across the plug device may be equalized by adding or reducing pressure above the plug. This may, in most cases, be difficult or very impractical to do. It is much more desirable in most cases to provide equalizing means in the plug device, and such means is shown in plug device 70, but will be described later.

Plug device 70 is provided with means for locking the plug member 102 to the mandrel means 104 when the plug member is in its upper position for preventing the mandrel means 104 from being moved to its upper unlocking position. Since the plug member is lifted to its upper position by an over pressure beneath it, unlocking the plug device at such time would likely result in the plug device being blown upwardly from its receptacle. In such case, the wire line would almost certainly be tangled and broken and the wireline tools and the plug device wrapped therein and lodged in the well tubing. Thus, a difficult fishing job would be created which may be costly and time consuming to perform.

The means for locking the mandrel means to the plug member will be described later.

Mandrel means 104 includes the tubular mandrel 200 which has a large upper end portion and has a smaller lower end portion which is telescoped into the bore of the housing means 100 in which it is slidable between upper and lower positions, soon to be described.

The tubular mandrel 200 is provided with a bore 202 which is enlarged slightly at 204 and further enlarged as at 206 and 08, as shown, providing an internal downwardly shoulder 210 which is engageable by suitable handling tools such as running and pulling tools by which the device is installed in and removed from wells. Bore 206 resumes again above internal shoulder 210 and is then flared as at 212 to provide a guide surface for guiding such handling tools into bore 208. Thus, a conventional internal fishing neck is provided at the upper end of the mandrel.

Bore 202 of the mandrel has its lower portion enlarged as at 216 and is flared at its lower end to form a guide surface 18 as shown.

Mandrel 200 is formed with a sizeable external annular recess 224 in which is carried an expander 226 providing an upwardly facing shoulder 228 at its upper end and a downwardly facing shoulder 230 at its lower end. The expander is formed with a cam shoulder 232 which is inclined downwardly and inwardly. Upward movement of the mandrel 104 in the housing means 100 is limited by engagement of upwardly facing shoulder 228 with the lower end 138 of upper housing 110, as seen in FIG. 14B. Downward movement of the mandrel in the housing means is limited by engagement of the downwardly facing inclined shoulder 232 of the mandrel with the corresponding upwardly facing inclined shoulder 145 in the lower housing 112, as shown in FIG. 4B.

When mandrel 104 is in its upper position, locking lugs 74 are free to retract in their windows 75. When the mandrel is moved downward in the housing means, the inclined shoulder 232 engages a similar inclined shoulder 234 on the inward side of the locking lugs 74 and this downward relative movement of the expander 226 cams the locking lugs outward, as into the locking recess in the landing receptacle, before explained. It is to be noticed that the locking lugs 74 reach their outermost position long before the mandrel arrives at its lowermost position, which serves a purpose to be brought to light shortly.

Mandrel 104 has its lower end portion reduced in outside diameter as at 240 and a wide annular recess 242 is formed in its exterior surface near the mandrel's lower end, as seen in FIG. 4B, and providing upper and lower divergent shoulders 241*a* and 241*b*. This wide recess 242 on the mandrel is engageable by the transfer lug 246 which is mounted in window 248 formed in the wall provided by upwardly opening blind bore 247 of the plug member 102 when the plug member 102 is in its upper position. When the plug member 102 is moved to its upper position, transfer lug 246 is cammed to its inner position by the inclined shoulder 150 at the upper end of annular recess 148 and these transfer lugs are then confined by the surrounding bore 146 above recess 148. It is seen that mandrel 200 in FIG. 4B is capable of being lifted only sufficiently high to bring the lower edge 242*a* of its recess 242 into engagement with transfer lug 246, as clearly shown in FIG. 15. This is the intermediate position of the mandrel. The mandrel can be lifted no higher so long as the plug member 102 remains in its upper position, shown. It is also clearly shown in FIG.

15 that, when the mandrel 104 is in its intermediate position, the locking lugs 74 remain in their locking position, being fully supported against inward movement by the expander 226 of the mandrel. Thus, when the plug member 102 is in its upper position, the mandrel is securely locked thereto by the transfer lugs 246 being confined to their inner positions by the inner wall of bore 146 of the lower housing, and cannot be lifted sufficiently to effect unlocking of the plug device.

Figure 14A:
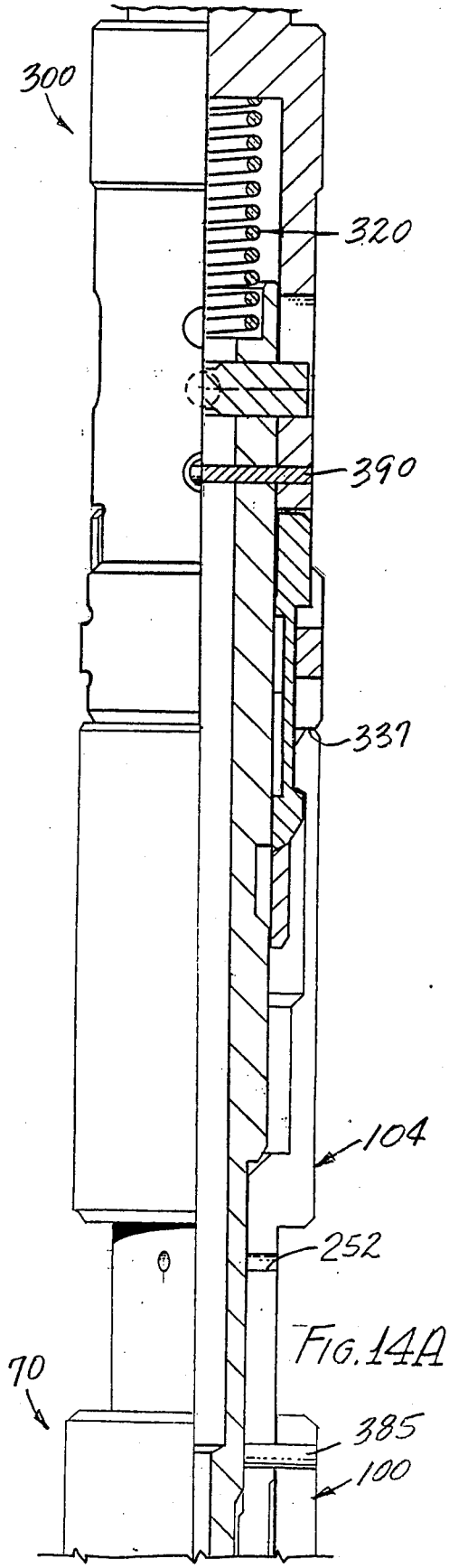
FIGS. 14A and 14B, taken together, constitute a fragmentary longitudinal view partly in section and partly in elevation, showing the combination plugging tool and running tool of this invention latched together as they would appear while being lowered into a well tubing.
Figure 14B:
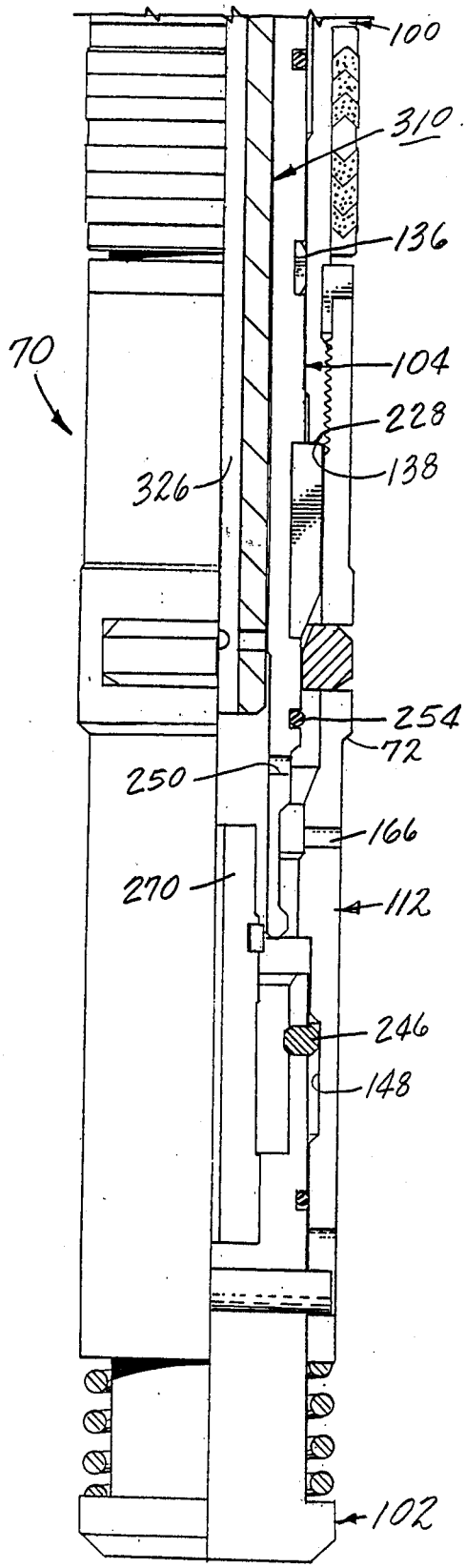

When the pressures above and below the plug device become nearly equalized, the spring 182 will expand and move the plug member 102 from its upper position (FIG. 4B) to its lower position (FIG. 14B). When the plug is, thus, in its lower position, the transfer lug 246 is in alignment with the surrounding internal recess 148 and will not interfere with movement of the mandrel. Thus, the plug device can be unlocked freely while the plug member is in its lower position.

Figure 15:
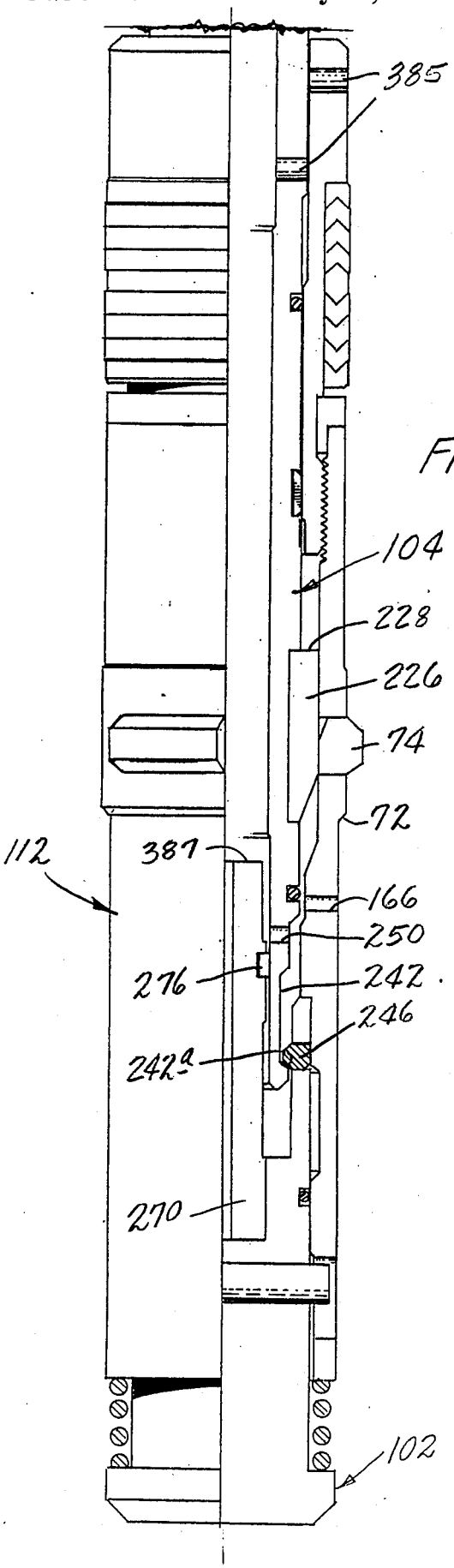
FIG. 15 is a fragmentary view, partly in section and partly in elevation, showing the plugging device of this invention as it would appear during equalization of pressures thereacross.

While the plug device cannot be unlocked while the plug member is held in its upper position, as when the pressure below the plug device is somewhat greater than that above, such pressure difference can be eliminated by equalizing the pressures through opening of the equalizing passage provided in the plug device 70 which includes the equalizing port 166 located a short distance below the no-go shoulder 72 of the lower housing 112. During the equalization of pressures across the plug device, this equalizing port 166 is in fluid communication with a similar equalizing aperture 250 formed in the wall of the mandrel a short distance above the external recess 242 in which the transfer lug 246 is engaged, as seen in FIG. 15. In FIG. 15, it is readily seen that fluids may pass through equalizing port 166 into the interior of the lower housing and, from there, pass through equalizing aperture 250 into the bore of the mandrel 104. From there, the fluids may flow freely upward to issue from the upper portion of the mandrel. To aid in such flow, ports 252 (see FIG. 4A) are formed in the wall of the mandrel a short distance below the enlarged portion 200 of the mandrel and are exposed above the upper end of the housing means 100 when the mandrel is in its intermediate, or equalizing, position.

When the mandrel 104 is in its lower position, as seen in FIGS. 4A and 4B, the equalizing passage through plug device 70 is closed and the device will maintain the landing receptacle tightly plugged. As mentioned earlier, seal ring 178 seals between the plug member 102 and lower housing 112 at a location just above longitudinal slots 170. The mandrel 104 carries two seal rings, lower and upper. The lower seal ring is shown in FIG. 4B as o-ring 254 carried in a suitable annular groove formed in the mandrel above equalizing aperture 250 and which seals between with the bore wall 140 of the lower housing below the equalizing port 166. Thus, seal ring 254 separates these two ports (166 and 250). The upper seal ring, shown to be an o-ring 260, is carried in a suitable annular groove on the mandrel and seals with the bore wall 133 of the upper housing at a location somewhat above the locking lug windows 75. Thus, these two o-rings (254 and 260) seal above the windows and below the equalizing port to prevent any fluids from entering the bore of the mandrel therethrough. Thus, no fluid is permitted to enter the housing means from the side (because of mandrel 104 and o-rings 254 and 260), or from below (because of plug member 102 and its o-ring 178), or to leak past the plug device 70 (because of the packing 118).

The mechanism which serves to lock the mandrel 104 to the plug member 102 and which includes transfer lugs 246, their windows 248, the related recesses 148 and 242 in the lower housing 112 and the mandrel 104, respectively, may be susceptible to malfunctioning due to sand, debris, or the like settling thereinto. Means are provided for preventing such mishap, as will now be explained.

While the upwardly opening bore **247*a* of the plug member may be formed as shown in plug member 102*a* of FIG. 6, it is highly recommended to form the bore as shown in FIG. 4B. Plug member 102 of FIG. 4B is provided upwardly opening blind bore 247 which includes a lower reduced portion 247*b*. A stem 270 is secured by suitable means in reduced bore portion 247*b* and extends upwardly, as shown, to a location somewhat above equalizing port 166 of the lower housing. A spaced distance below its upper end the stem is enlarged slightly as at 272 to provide a fairly close fit with bore portion 216 of the mandrel 104 in which it is received. In the device shown, the upper end portion of the stem extends up past bore 216 of the mandrel and into bore 202 a short distance. Near the upper end of enlarged portion 272, the stem 270 is provided with a suitable external annular groove in which is carried a wiper ring, such as C-ring 276. This C-ring has a close sliding fit with the inner wall of the mandrel bore 216, but since it has been cut to form a "C", it is provided with a gap. This gap is sufficiently narrow to prevent trash and most solid particles from entering the region therebelow, but is wide enough to prevent trapping pressure therebeneath. The wiper ring may be formed of a suitable metal, fibrous material or plastic. In the device constructed in accordance with this invention, the wiper ring 276** was formed of NYLON. Thus, the wiper ring forms a barrier which will quite effectively prevent sand, debris, or the like from entering and, perhaps, fouling the mechanism therebelow.

The plug device 70 is installable in a well having a landing receptacle, such as the landing receptacle 40 previously described. The plug device is lowered into the well on a conventional tool string (not shown) attached to a conventional wire line (not shown). The plug device is releasably attached to the tool string through use of suitable running tool. While an Otis Type GS running tool can be used, the ideal running tool for use with the plug device is the running tool illustrated in FIGS. 8A, 8B and 9–13 where it is indicated by the reference numeral 300.

Figure 8A:
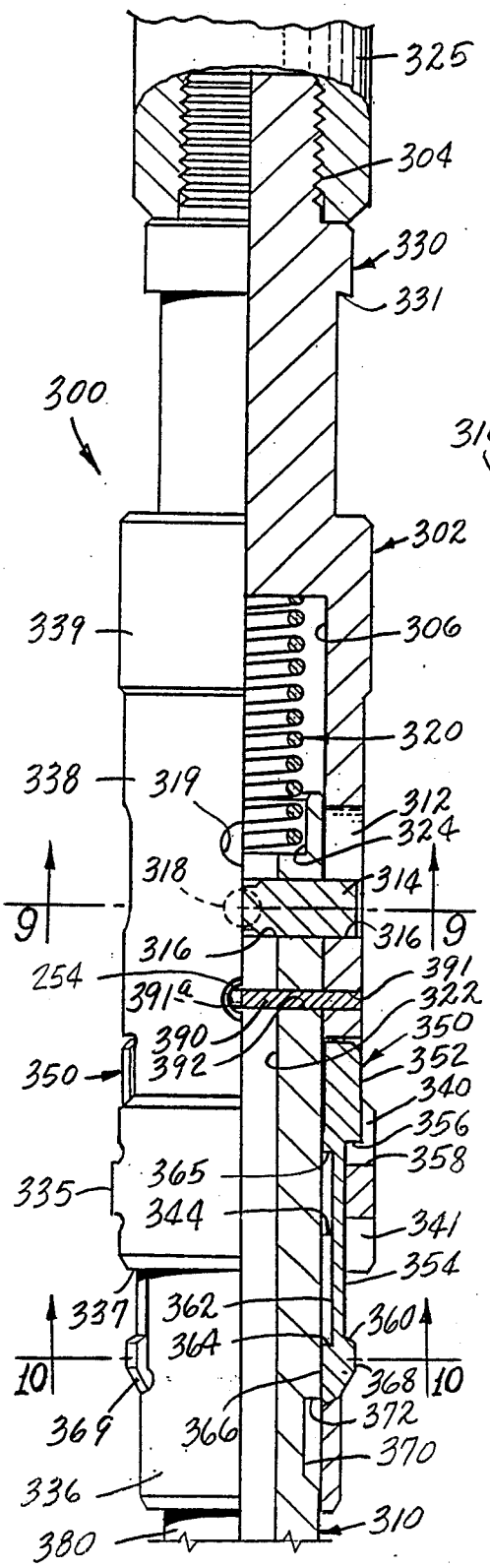
FIG. 8A and 8B, taken together, constitute a longitudinal half-sectional view of the running tool of this invention used to install the plugging tool of this invention in the landing receptacle of FIG. 2.
Figure 9:
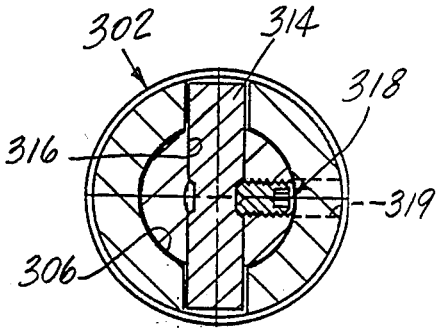
FIG. 9 is a cross-sectional view taken along line 9—9 of FIG. 8A.
Figure 11:
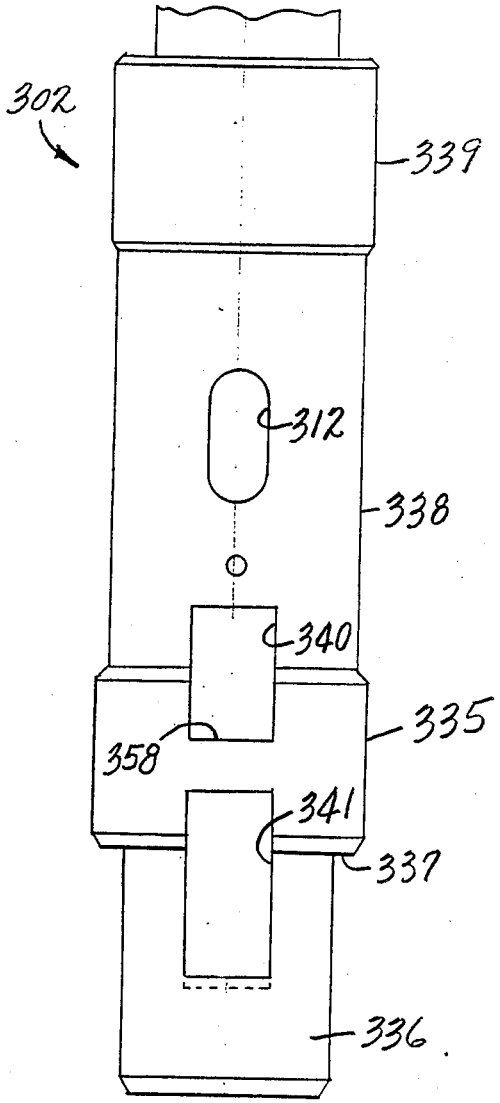
FIG. 11 is a fragmentary elevational view of the body of the running tool of FIGS. 8A and 8B.
Figure 12:
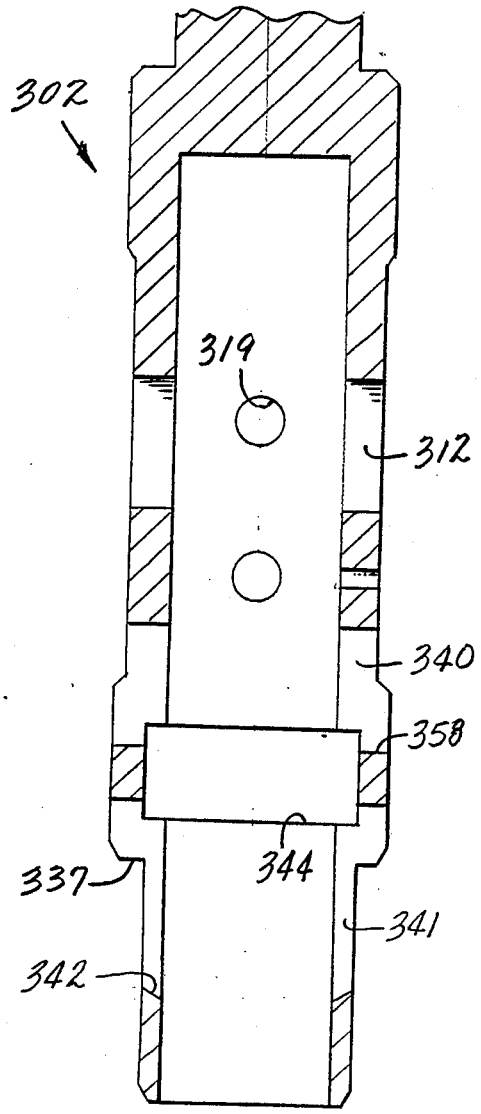
FIG. 12 is a sectional view of the body seen in FIG. 11, but rotated 90° about its longitudinal axis.

Running tool 300 comprises a body 302 having means, such as thread 304, at its upper end for attachment to a wireline tool string and having a downward opening blind bore 306. A tubular core 310 has its upper end portion telescoped into said body bore 306 and is movable longitudinally therein between upper and lower positions. Body 302 has a pair of longitudinal slots 312 formed through its wall as shown, and a crosspin 314 is disposed in a diametral hole 316 through said core and has its opposite ends engaged in said longitudinal slots 312. A set screw 318, as seen in FIG. 9, secures crosspin 314 in hole 316 of the core. Access to screw 318 is had through hole 319 in the wall of the body 302. Core 310 is shown in its lower position in FIG. 8A. In this lower position, crosspin 314 is engaged with the lower ends of longitudinal slots 312. The upper position of the core will become clear later. The body is provided with a vent **319*a* and the core is provided with a port at 319*b*. These two ports are aligned as seen in FIG. 8A when the shear pin 390** is in place. The aligned ports allow fluids to enter or exit the plug device.

Means for biasing body 302 upward relative to core 310 is provided. In the illustration of FIG. 8A, such biasing means is seen to be a coil spring 320 having its lower end bearing downwardly on the upper end of core 310 and its upper end bearing upwardly against the upper end of blind body bore 306. The bore 322 of core 310 may be enlarged at its upper end as at 324 to centralize and guide the spring, as shown. Bore 322 is reduced as at 326 to provide a flow passage and yet retain adequate column strength in the small-diameter portion 384 of the core. The normal position for the body upon the core is that shown in FIG. 8A, the body being biased to such position by spring 320.

Body 302 is connectable to a tool string, indicated by reference numeral 325 and may be formed with a conventional wireline connection at its upper end providing, in addition to thread 304, a fishing neck 330 which includes the usual downwardly facing undercut shoulder 331. Body 302 has an outside diameter which is largest at 335 and which is reduced therebelow as at 336, providing a downwardly facing shoulder 337. Also, the body's outside diameter is reduced, above the area of largest diameter, as at 338 and is then enlarged slightly as at 339, then thereabove the fishing neck is formed as shown. See also FIGS. 11 and 12.

A pair of longitudinally aligned upper and lower windows 340 and 341, respectively, are formed through the wall of the body 302 and are spaced apart a short distance as shown. This short space between the upper and lower windows is substantially centered with respect to large diameter portion 335 of the body. The lower window is about 50 percent longer than the upper window while both windows are substantially equal in width. Body 302 is formed with an internal annular recess 344 which is wider than, and underlies the space between, the upper and lower windows 340 and 341 whose purpose will soon be made known.

A pair of keys 350 is carried by body 302, one in each of the oppositely located aligned upper and lower windows, 340, 341. Each key 350 is of a width to fit loosely in the windows. The upper end portion 352 of the key is rather thick and its outer face is recessed as at 354 providing an abrupt downwardly facing shoulder 356, which is engageable with the bottom 358 of upper window 340, and an upwardly facing inclined shoulder 360 which is engageable with the internal fishing neck 210 of the plug device. The inside face of the key is recessed as at 362 providing an abrupt upwardly facing shoulder 364 and an abrupt downwardly facing shoulder 365, as shown.

Figure 8B:
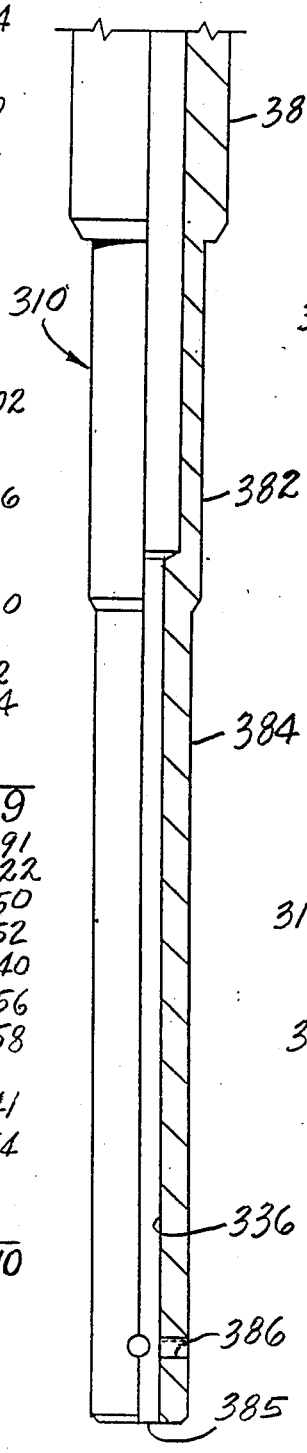
Figure 10:
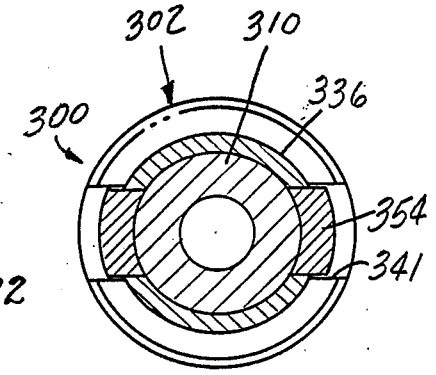
FIG. 10 is a cross-sectional view taken along line 10—10 of FIG. 8A.
Figure 13:
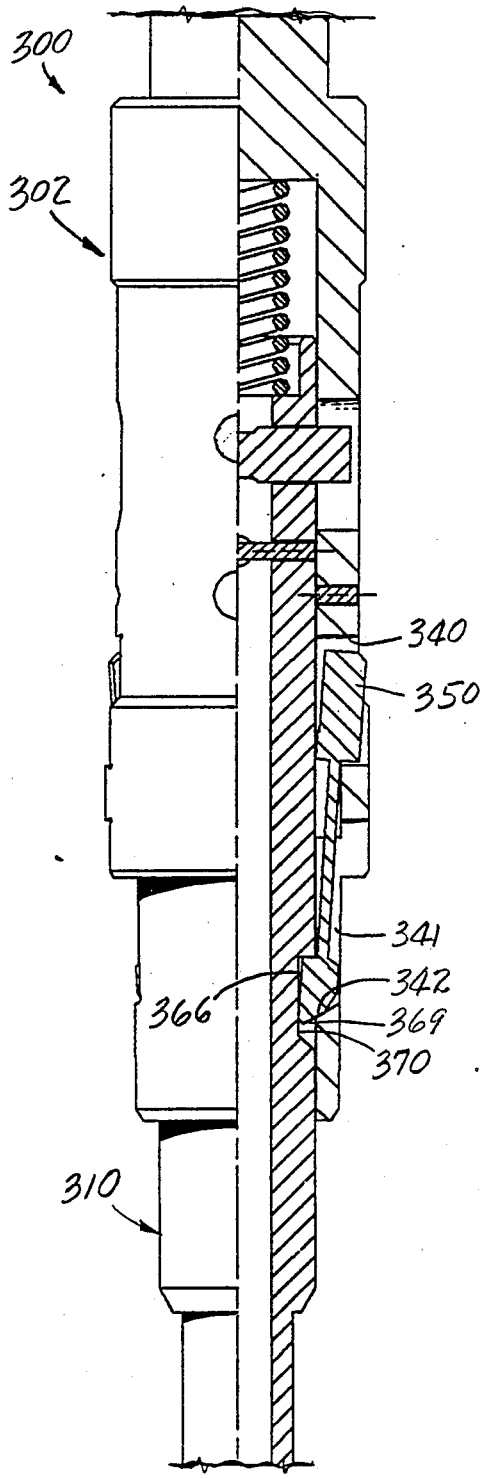
FIG. 13 is a fragmentary view of the running tool of FIGS. 8A and 8B as it would appear after having set the plug device of FIGS. 4A and 4B in the receptacle of FIG. 2.

The lower end portion of the key 350 then is formed with an inner boss 366 and an outer boss 368. The outer boss 368 is for engaging and supporting the plug device 70; the inner boss is for engaging in the external annular recess 370 formed in the core 310 at a location near the lower end of body 302 when the core is assembled with the body as seen in FIGS. 8A and 8B. When the inner boss 366 of the key 350 retracts into core recess 370, as shown in FIG. 13, it disengages the fishing neck of the plug device, and as it does, the coil spring 320 lifts the body 302 relative to the core. The lower end of the key is formed with an end surface 369 which is inclined upwardly and outwardly. Thus, an upward bias applied to the body 302 tends to lift the body and cause the lower end of the lower window 341 which is similarly inclined as at 342 to tend to cam the lower end of the key further inwardly and will not allow it to move outwardly. This assures that the upwardly facing abrupt shoulder 364 of the key will engage the corresponding downwardly facing abrupt shoulder 372 of recess 370 of the prong and continue to do so. Since the coil spring 320 will thereafter maintain an upward bias on the body 302, these two abrupt shoulders 364 and 372 and the inclined lower end of window 342 bearing against the lower end of the key will prevent the key from swinging outward to re-engage the fishing neck of the plug device, thus permitting the running tool 300 to be readily lifted free of the plug device and to be withdrawn from the well. The lifting of the tool string lifts the body 302, and as it is lifted, the key riding on the inclined bottom 342 of the window 341 lifts the core 310.

The core 310 of the running tool has its intermediate and lower portions formed smaller in diameter than its upper end portion. Thus, its largest diameter is at 380. Its diameter is then reduced for the intermediate portion as at 382, and is further reduced as at 384 for the lower portion, as shown, so that it will fit fairly loosely within the bore of the plug device above the upper end 383 of stem 270. The clearance between the exterior of the core and the interior wall of the plug device provides added flow passage for the bypassing of well fluids as the plug device is moved into the well and also in equalizing pressures across the plug device. The core 310 terminates at its lower end, as at 385. If desired, one or more lateral ports such as ports 386 may be provided in the core wall as shown to permit easy entrance of fluids into the central passage 326 of the core.

Before installing the plug device 70 in a well, it must be made ready by moving the mandrel 104 to its uppermost position in the housing means 100, as shown in FIGS. 14A and 14B. Next, the shear pin 390 must be installed to secure the mandrel in this upper position. When the mandrel is, thus, in its upper position, its lower o-ring 254 is above equalizing port 166 in the lower housing. The equalizing passage through the plug device is open, therefore, and provides a bypass for well fluids as the plug device is being lowered in the well.

The mandrel 104, as shown in FIG. 4A has been drilled to accommodate 4 shear pins 385. The upper housing 110 is drilled accordingly. These shear pins are short, only extending through the housing and mandrel walls; they do not extend into the bore of the mandrel (see also FIG. 14A). While four such shear pins may be generally used, fewer shear pins can be used, if desired. In fact, not only can the number of shear pins be varied, but their size and the material from which they are made may be varied also to provide the desired shear value.

When the plug device has been made ready, the running tool 300 is prepared for connection therewith as follows. The running tool is stood upright with the lower end of its core on a firm surface. The body 302 is forced downward relative to the core. This compresses the spring 320 as the keys 350 slide downward along the outer surface of the core. When the inner bosses of the keys reach the recess 370 of the core, they will engage therein (see FIG. 13). Thus, the keys are tilted so that their inner ends are inward and their outer ends are tilted outward, the keys having pivoted about the corner of their abrupt shoulder 365 at the upper end of recess 362 formed in the inner face of the keys. The downward force is now removed from the body 302 and the keys will remain retracted. Of course, to assure that the keys are in proper position, the operator can hold the lower ends of the keys retracted while the body is relieved of the downward force. The lower ends of the keys will become trapped between the upper end of recess 370 and the lower inclined end of window 341.

The running tool core is then inserted into the bore of the plug device. The running tool will stop when the downwardly facing shoulder 337 of the body comes to rest upon the extreme upper end of the mandrel, as seen in FIG. 14A. The lower end of the core will, at this time, be well above the upper end 383 of the stem 270 as seen in FIG. 14B. The core is now lifted slightly by lifting crosspin 314 with a screwdriver placed under one end thereof in slot 312 to provide room for the lower end of the key to escape from between the shoulder 372 of the core recess and the inclined lower end of window 341, while the extreme upper ends of the keys are squeezed toward one another as by hand. This causes the keys to move to their untilted expanded position, permitting the inner boss 366 of the keys to disengage from and rise past core recess 370 as the screwdriver is disengaged and the core is allowed to move to its lowermost position relative to the body. The keys are now held expanded by the core and their outer boss 368 being now engaged with downwardly facing shoulder 210 in the mandrel will support the plug device.

The shear pin 390 may now be installed in the aligned apertures 391 and 392 of the body 302 and core 310, respectively, as shown in FIG. 8A, to secure them together against relative longitudinal movement. The running tool is now ready for attachment to the wireline tool string for the trip into the well. It is to be understood that while the shear pin is not required, its use is recommended.

For installation, the plug device 70 is lowered into the well tubing on the running tool 300 until the landing receptacle 40 is encountered. It may require some force to drive the plug device into the receptacle, especially since the packing rings 118 fit tightly therein. This is normally done by downward jarring impacts generated by operation of jars and weight in the tool string brought about by manipulation of the wire line at the surface.

The plug device stops moving downward when its no-go shoulder 72 engages the corresponding no-go shoulder 60 in the landing receptacle. At this time, the locking lugs are aligned with the locking recess 56 of the receptacle and the packing 118 is in sealing position in the seal bore **50*a* of the receptacle. Additional downward impacts applied to the running tool will soon cause shearing of shear pins 385 which allows the mandrel 104 to move down relative to the housing means 100. During this relative downward movement of the mandrel, several events take place and in the following order. About midway of the expander's downward travel, the locking lugs 74 become fully expanded and are fully supported by the expander 226 against inward movement. Next, the lower end of the core engages the upper end 287 of stem 270 and is stopped. Downward jarring forces the body 302 downward relative to the core and causes the shearing of shear pin 390. As the body continues to move down relative to the core, the keys move toward the outer recess 370 of the core. A short distance before the mandrel reaches its lowermost position, the detent 136 on the mandrel reaches and enters the detent recess 134, the lower seal 254 of the mandrel effects a seal below the equalizing port 166 to close the equalizing passage through the plug device, and soon thereafter, the inner bosses 366 of the keys reach and enter the core recess 370, as they disengage the fishing neck of the mandrel. Immediately following this, the mandrel is stopped by the tapered shoulder 232 of the expander engaging the corresponding tapered shoulder 145 in the lower housing 112**. Now, with the keys retracted, the running tool may be lifted free of the plug device and removed from the well.

The detent being expanded and releasably engaged in detent recess 134 will not allow the expander to be moved from its lower position easily.

The plug is thus left in position plugging the bore of the landing receptacle and will not permit fluid flow through the landing receptacle in either longitudinal direction—upwardly or downwardly. The plug device is removable.

In removing the plug device 70 from its landing receptacle 40, a suitable pulling tool such as the well-known type "GR" Otis Pulling Tool (not shown) available from Otis Engineering Corporation, Dallas, Texas, is recommended. The type "GS" Otis Pulling Tool also is suitable. This pulling tool is run into the well on a wire line and will readily releasably engage the downwardly facing shoulder 210 of the fishing neck at the upper end of the mandrel 104. It will not disengage until its shear pin has been sheared.

If the pressures above and below the plug device are substantially equalized, the plug member 102 will be in its lowermost position (seen in FIG. 14B) and the core 104 can be lifted to its uppermost (unlocking) position with only a little resistance. Of course, when the mandrel reaches its uppermost position and the locking lugs 74 have been freed to retract to their unlocked position, upward jarring impacts with the wireline tools are utilized to extract the plug device from the landing receptacle. Most of this resistance encountered in the extraction operation is due to the tight fit of the packing rings 118 in the seal bore portion **50*a*** of the landing receptacle. Upon extraction of the plug device from the landing receptacle, the plug device can be lifted to the surface in the usual manner.

If, when the pulling tool is engaged with the plug device, the pressure therebelow exceeds that thereabove by as much as about 20 pounds per square inch, the plug member 102 will be in its uppermost position (seen in FIG. 4B) and, as was before explained, the lower end of the mandrel 104 will be locked to the plug member 102 and cannot be lifted to its uppermost (unlocking) position. In such case, the core is lifted to and held in its intermediate position shown in FIG. 15. In this position, the high pressure below the plug device is vented through the now open equalizing passage until pressures across the plug device are substantially equalized. During the equalizing process, fluids from below the plug device flow through the lateral equalizing port 166 of the lower housing 112, enter the core through lateral port 250, which is now elevated above the level of wiper ring 276, and travel upward through the mandrel bore, to exit the mandrel at vents 252 (see FIG. 4A).

Upon substantial equalization of the pressures across the plug device, the spring 182 will return the plug member 102 to its lower position and, at the same time, will release the mandrel 104 for further upward movement to its unlocking position, after which the plug device may be forced upward out of the landing receptacle and retrieved to the surface. If the pressure above the plug is greater than that below, opening of the equalizing passage by lifting the mandrel will allow the pressure to equalize, after which the plug device can be extracted from the landing receptacle.

Should the plug device, for some reason, be fouled in its receptacle, as with its plug member stuck in its upper position despite the fact that the pressure below it is no greater than that above, upward jarring impacts of the wireline tools may be used to shear the shear pin in the pulling tool, causing it to disengage the plug device. The pulling tool may then be lifted to the surface. Then, if desired, a suitable prong (not shown) may be threadedly attached to the lower end of the pulling tool. When the pulling tool is latched into the plug device, the prong will engage the upper end 287 of stem 270. Downward impacts delivered by the jar action of the wireline tools will be transmitted through the pulling tool and prong, and through the stem 270 to the plug member 102. Thus, the plug member may be freed for movement to its lower position, or be forced to such position. The mandrel may then be lifted to its unlocking position and the plug device extracted from its landing receptacle in the manner explained earlier.

Pressures across the plug device may be also equalized, indeed even over-equalized, by building pressure thereabove as by pumping into the well at the surface.

Figure 16:
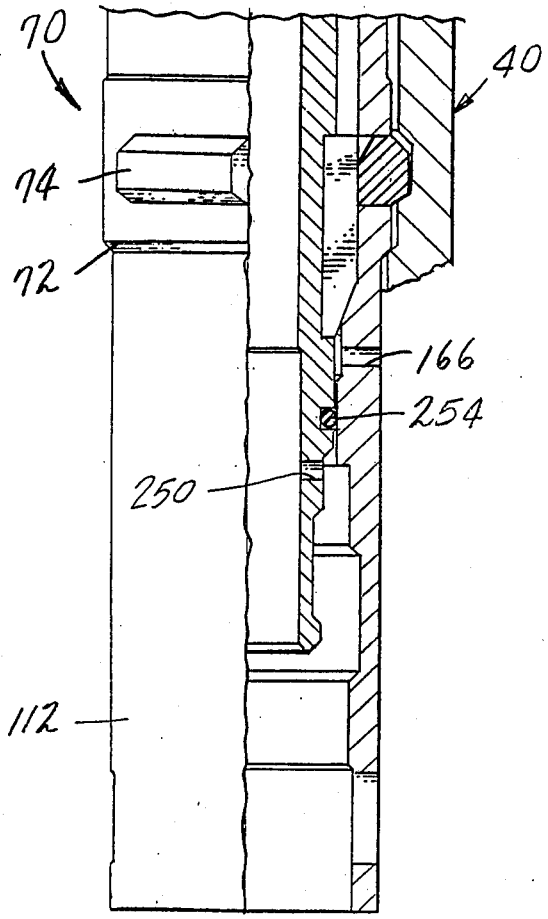
FIG. 16 is a fragmentary view, partly in section and partly in elevation, showing the lower portion of the plugging tool of this invention as it would appear after the plug member thereof has been expelled from its lower end.

If the plug member 102 is stuck in its upper position so that the plug device cannot be unlocked for withdrawal from the landing receptacle, pressure can be increased above the plug device until the net downward force acting upon the plug member 102 is not only sufficient to move the plug member down but to shear off the ends of pins 172 to thus expell the plug member 102 from the plug device. The coil spring 182 will then drop to the lower part of the well. After the plug member has been thus ejected, the plug device 70 will be open as seen in FIG. 16, and will be ready to be unlocked and removed from the well.

Such may be the most expedient way to deal with the problem of the stuck plug member, especially if a rig is on location and if there are pumping means readily available for adequately pressurizing the well tubing above the plug device.

It should be understood that, even though the instant invention has been illustrated and described with respect to two-way plugs, the invention can be embodied in one-way plugs as well. For instance, the plug member 102 could be provided with a longitudinal through passage with a check valve installed therein to permit fluid flow therethrough in one direction and prohibit fluid flow in the other direction. Since the crosspin 172 would likely interfere with such through passage in the plug member, it may be desirable to use a pair of short suitable screws in place of the crosspin so that their heads would occupy the slots 170 in the lower housing 112. Such one-way plugs may be desirable for plugging and/or testing well flow conductors through use of their ability to withstand overpressuring from above or below, depending upon the direction in which the check valve prohibits fluid flow.

The foregoing description and drawings of the invention are explanatory and illustrative only, and various changes in sizes, shapes, and arrangement of parts, as well as certain details of the illustrated construction, may be made within the scope of the appended claims without departing from the true spirit of the invention.

We claim:

1. A device for plugging a well flow conductor having a landing receptacle therein, said device comprising:

(a) tubular housing means having a bore extending therethrough;

(b) means on said housing means for releasably locking said housing means in said landing receptacle;

(c) means sealing between said housing means and the inner wall of said landing receptacle;

(d) means including a plug member for closing the lower end of said bore of said housing means, said plug member being movable longitudinally relative to said housing means between upper and lower positions;

(e) mandrel means reciprocable in said bore of said housing means for actuating said locking means to locking position in response to relative downward movement of said mandrel means and for allowing said locking means to move to releasing position in response to relative upward movement of said mandrel means, said mandrel means having a fishing neck at its upper end providing a downwardly facing shoulder engageable by a running tool; and (f) means for releasably locking said mandrel means to said plug member when said mandrel means in its lower position and said plug member is in its upper position, said mandrel means being released from said plug member in response to relative downward movement of said plug member.

2. The device of claim 1, wherein said means for releasably locking said housing means in said landing receptacle is locking lugs carried in windows formed in said housing means and movable therein between inner retracted and outer locking positions, and wherein said means for closing the lower end of said bore of said housing means includes: (a) means for limiting both upward and downward movement of said plug member relative to said housing means; and (b) means for biasing said plug member toward its lower position.

3. The device of claim 2, wherein said housing means and said mandrel means include: means for limiting both upward and downward movement of said mandrel means relative to said housing means.

4. The device of claim 3, wherein said means for biasing said plug member toward its lower position is a spring, and said mandrel means and said housing means further include:

(a) means for releasably securing said mandrel means in its upper position in said housing means, and (b) means on said mandrel means and means on said housing means coengageable for releasably retaining said mandrel means in its lower position in said housing means.

5. The device of claim 4, wherein said means for releasably securing said mandrel means in its upper position in said housing means is a shear pin disposed in aligned apertures in said mandrel means and said housing means, and said means for limiting movement of said plug member relative to said housing means includes:

pin means carried by said plug member and having its ends engaged in longitudinal slot means formed in said housing means, said pin means being shearable responsive to a predetermined downwardly acting differential pressure to expel said plug member from the lower end of said bore of said housing means.

6. The device of claim 1, 2, 3, 4, or 5, wherein said means for releasably locking said mandrel means in its lower position when said plug member is in its upper position includes:

(a) an upwardly facing inclined lock shoulder on said mandrel means;

(b) at least one transfer lug member carried by said plug member, said transfer lug member being movable between an inner position wherein it is engageable with said upwardly facing inclined lock shoulder on said mandrel means to lock said mandrel means to said plug member, and an outer position wherein it is not engageable with said lock shoulder; and (c) a downwardly facing inclined cam shoulder formed on said housing means for moving said transfer lug member to its inner position in response to said plug member being moved to its upper position.

7. The device of claim 6, wherein said housing means is provided with an external downwardly facing no-go shoulder for limiting downward movement of said device in said receptacle.

8. The device of claim 7, in combination with a running tool, said running tool comprising:

(a) body means having means at its upper end for attachment to a tool string and a longitudinal bore therein opening downwardly;

(b) a core having its upper end portion slidably disposed in said bore of said body;

(c) means on said housing and said core for limiting movement of said core relative to said body;

(d) means biasing said body means upwardly relative to said core;

(e) means releasably securing said body means in its upper position relative to said core;

(f) a downwardly facing shoulder on said body means engageable with the upper end of said mandrel of said plug device;

(g) means for releasably engaging said downwardly facing shoulder of said fishing neck to support said plug device and being releasable responsive to locking said plug device in said landing receptacle, the lower end of said core becoming engaged with said plug member, and said body being moved farther downward relative to said core to release said means securing said body in its upper position relative thereto and to permit said means engaging said downwardly facing shoulder of said fishing neck to retract and to free said running tool for withdrawal from said plug device, leaving said plug device in locked and sealed position, plugging said landing receptacle.

9. The device and running tool of claim 8 in combination with a landing receptacle, said landing receptacle comprising:

(a) tubular body means having a bore extending longitudinally therethrough, (b) an internal annular locking recess formed in the wall of said bore intermediate the ends of said tubular body means engageable by said releasable locking means on said plugging device, (c) an upwardly facing annular no-go shoulder below said locking recess engageable by said plugging device for locating the same in said landing receptacle, and (d) a seal bore portion spaced above said locking recess engageable by said means for sealing between said housing means and said landing receptacle when said locking means is engaged in said locking recess.

10. A running tool for installing a plug device in a receptacle in a well flow conductor, said plug device having a tubular housing having a bore and being provided with expansible, contractable locking means, a downwardly facing external no-go shoulder below said locking means, seal means above said locking means, a plug member closing the lower end of said bore of said tubular housing, a mandrel having its lower end portion telescoped into said tubular housing, said mandrel having a fishing neck at its upper end providing a downwardly facing shoulder, said mandrel having means for moving said locking means to expanded locking position in response to said mandrel being moved from an upper to a lower position in said tubular housing, said running tool comprising;

(a) body means having means at its upper end for attachment to a tool string and a longitudinal bore therein opening downwardly, (b) a core having its upper end portion slidably disposed in said bore of said body;

(c) means on said housing and said core for limiting movement of said core relative to said body;

(d) means biasing said body upwardly relative to said core;

(e) a downwardly facing shoulder on said body means engageable with the upper end of said mandrel means of said plug device; and (f) means for releasably engaging said downwardly facing shoulder of said fishing neck to support said plug device and being releasable responsive to locking said plug device in said landing receptacle, the lower end of said core becoming engaged with said plug member, and said body being moved further downward relative to said core to release said means securing said body in its upper position relative thereto and to permit said means engaging said downwardly facing shoulder of said fishing neck to retract and free said running tool for withdrawal from said plug device, leaving said plug device in locked and sealed position, plugging said landing receptacle.

11. The running tool of claim 10, wherein said means for limiting movement of said body means relative to said core, includes:

(a) longitudinal slot means formed in the wall of said body means; and (b) a crosspin carried by said core and having its ends engaged in said longitudinal slot means in said body means.

12. The running tool of claim 11, wherein said biasing means is a coil spring in said body bore and has its lower end bearing downwardly upon said core; and wherein said running tool further includes means for securing said body in its upper position relative to said core.

13. The running tool of claim 12, wherein said means for releasably engaging said downwardly facing shoulder of said fishing neck comprises:

(a) at least one window formed in the wall of said body means below said longitudinal slot means;

(b) a key in said at least one window, said key being formed with an outer boss providing an upwardly facing shoulder for engaging said downwardly facing shoulder of said fishing neck, the lower end surface of said key being engageable by the lower end of said window, the lower end surface of said key and the mating surface defining the lower end of said window being inclined downwardly and inwardly, the lower end of said window supporting said key and downward loads transmitted thereto through said key.

14. The running tool of claim 13, wherein said key is formed with an inner boss providing an abrupt upwardly facing shoulder, and said core is provided with external recess means providing an abrupt downwardly facing shoulder at its upper end; said recess means receiving said inner boss of said key when the lower end of said key is moved to retracted position, said abrupt shoulders of said key and said recess means being engaged and said spring then applying a downward bias to said core to maintain such engagement of said abrupt shoulders, whereby when the body means is lifted, a lifting force is applied to the core through the inclined lower end surface of the window, the lower portion of the dog and the engaged abrupt shoulders of the dog and the core recess; and wherein said means for securing said body means in its upper position relative to said core is a shear pin disposed in aligned apertures in said core and said body means.

15. A device for plugging a well flow conductor having a landing receptacle therein, said device comprising:

(a) tubular housing means having a bore extending therethrough;

(b) means on said housing means for releasably locking said housing means in said landing receptacle;

(c) means sealing between said housing means and the inner wall of said landing receptacle;

(d) means including a plug member for closing the lower end of said bore of said housing means, said plug member being movable longitudinally relative to said housing means between upper and lower positions;

(e) mandrel means reciprocable in said bore of said housing means for actuating said locking means to locking position in response to relative downward movement of said mandrel means and for releasing said locking means in response to relative upward movement of said mandrel means;

(f) means for releasably locking said mandrel means to said plug member when said mandrel means in its lower position and said plug member is in its upper position, said mandrel means being released from said plug member in response to relative downward movement of said plug member;

(g) means providing an equalizing passage through the plugging device; and (h) means for controlling fluid flow through said equalizing passage.

16. The device of claim 15, wherein said means for releasably locking said housing means in said landing receptacle is locking lugs carried in windows formed in said housing means and movable therein between inner, retracted and outer, locking positions, and said mandrel means is provided with an enlargement thereon engageable with said locking lugs when said mandrel means is in its lower position to maintain them in their outer, locking position and to release said locking lugs for movement to their inner, retracted position upon said mandrel being moved to its upper position, and wherein said means for closing the lower end of said bore of said housing means includes:

(a) means for limiting both upward and downward movement of said plug member relative to said housing means; and (b) means for biasing said plug member toward its lower position.

17. The device of claim 16, wherein said housing means and said mandrel means include means for limiting both upward and downward movement of said mandrel means relative to said housing means; and said housing means includes a downwardly facing no-go shoulder formed thereon for limiting downward movement of said device in said receptacle.

18. The device of claim 17, wherein said means for biasing said plug member toward its lower position is a spring, and said mandrel means and said housing means further include:

(a) means for releasably securing said mandrel means in its upper position in said housing means, and (b) means on said mandrel means and means on said housing means coengageable for releasably retaining said mandrel means in its lower position in said housing means.

19. The device of claim 18, wherein said securing means is one or more shear pins disposed in aligned apertures in said mandrel means and said housing means, and wherein said seal means for sealing between said housing means and the inner wall of said landing receptacle is packing rings carried on said housing means, said device further including seal means for sealing between said mandrel means and said housing means.

20. The device of claim 19, wherein said enlargement on said mandrel means for maintaining said locking lugs in locking position is an external flange providing an abrupt upwardly facing shoulder at its upper end engageable with a corresponding downwardly facing shoulder in said housing means to limit upward movement of said mandrel means, and a downwardly and inwardly inclined shoulder at its lower end for camming said locking lugs to expanded locking position responsive to downward movement of said mandrel means relative thereto, said downwardly and inwardly inclined shoulder of said flange being engageable with a corresponding upwardly and outwardly inclined shoulder formed in said housing means for limiting downward movement of said mandrel means relative to said housing means.

21. The device of claim 20, wherein said mandrel means is formed with an external annular recess and said flange for expanding said locking lugs is formed separately in two pieces which are then seated in said external annular recess, said two pieces being of hardened metal, and wherein said mandrel means is formed with a longitudinal bore extending therethrough, and wherein said equalizing passage is provided by an equalizing port formed in the wall of said housing means below said downwardly facing no-go shoulder and an inner equalizing port formed in said mandrel means for permitting fluid flow to take place therethrough between the exterior of said housing means below said packing and the bore of said mandrel means, and said means for sealing between said mandrel means and said housing means includes a resilient seal ring carried in an annular seal ring groove formed in the exterior of said mandrel means just above said equalizing port therein, said resilient seal ring having sealing contact with the inner wall of said housing means at a location below said equalizing port thereof, thus prohibiting fluid communication between said equalizing port of said housing means and said equalizing port of said mandrel means when said mandrel means is in its lower position in said housing means, and permitting fluid flow through said equalizing ports when said mandrel means is in its intermediate position, and said plug member is formed with a stem projecting upwardly therefrom, said stem extending into the bore of said mandrel, and a wiper ring is carried in an annular recess near the upper end of said stem, said wiper ring preventing sand or other debris from settling from above into the working parts in the lower portion of the plug device.

22. The device of claim 15, 16, 17, 18, 19, 20, or 21, wherein said means for releasably locking said mandrel means in its lower position when said plug member is in its upper position includes:

(a) an upwardly facing inclined lock shoulder on said mandrel means;

(b) at least one transfer lug member carried by said plug member, said transfer lug member being movable between an inner position wherein it is engageable with said upwardly facing inclined lock shoulder on said mandrel means to lock said mandrel means to said plug member, and an outer position wherein it is not engageable with said lock shoulder; and (c) a downwardly facing inclined cam shoulder formed on said housing means for moving said transfer lug member to its inner position in response to said plug member being moved to its upper position.

23. The device of claim 22, wherein said means for limiting downward movement of said plug member relative to said housing means is releasable in response to a predetermined downward loading against said plug member whereby said plug member is expellable from the device.

24. The device of claim 23, in combination with a landing receptacle comprising:

(a) tubular body means having a bore extending longitudinally therethrough, (b) an internal annular locking recess formed in the wall of said bore intermediate the ends of said tubular body means engageable by said releasable locking means on said plugging device, (c) an upwardly facing annular no-go shoulder below said locking recess engageable by said plugging device for locating the same in said landing receptacle, and (d) a seal bore portion spaced above said locking recess engageable by said means for sealing between said housing means and said landing receptacle when said locking means is engaged in said locking recess.

25. The device of claim 23, a running tool for installing a plug device in a receptacle in a well flow conductor, said plug device having a tubular housing having a bore and being provided with expansible, contractable locking means, a downwardly facing external no-go shoulder below said locking means, seal means above said locking means, a plug member closing the lower end of said bore of said tubular housing, a mandrel having its lower end portion telescoped into said tubular housing, said mandrel having a fishing neck at its upper end providing a downwardly facing shoulder, said mandrel having means for moving said locking means to expanded locking position in response to said mandrel being moved from an upper to a lower position in said tubular housing, said running tool comprising;

(a) body means having means at its upper end for attachment to a tool string and a longitudinal bore therein opening downwardly, (b) a core having its upper end portion slidably disposed in said bore of said body;

(c) means on said housing and said core for limiting movement of said core relative to said body;

(d) means biasing said body upwardly relative to said core;

(e) means releasably securing said body means in its upper position relative to said core;

(f) a downwardly facing shoulder on said body means engageable with the upper end of said mandrel means of said plug device; and (g) means for releasably engaging said downwardly facing shoulder of said fishing neck to support said plug device and being releasable responsive to locking said plug device in said landing receptacle, the lower end of said core becoming engaged with said plug member, and said body being moved further downward relative to said core to release said means securing said body in its upper position relative thereto and to permit said means engaging said downwardly facing shoulder of said fishing neck to retract and free said running tool for withdrawal from said plug device, leaving said plug device in locked and sealed position, plugging said landing receptacle.

26. The device of claim 25, in combination with a landing receptacle comprising:

(a) tubular body means having a bore extending longitudinally therethrough, (b) an internal annular locking recess formed in the wall of said bore intermediate the ends of said tubular body means engageable by said releasable locking means on said plugging device, (c) an upwardly facing annular no-go shoulder below said locking recess engageable by said plugging device for locating the same in said landing receptacle, and (d) a seal bore portion spaced above said locking recess engageable by said means for sealing between said housing means and said landing receptacle when said locking means is engaged in said locking recess.

* * * * *